US007970322B2

(12) United States Patent
Ochiai

(10) Patent No.: US 7,970,322 B2
(45) Date of Patent: Jun. 28, 2011

(54) DEVELOPING ROLLER, DEVELOPING APPARATUS, AND IMAGE FORMING APPARATUS

(75) Inventor: Norikazu Ochiai, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 322 days.

(21) Appl. No.: 12/326,380

(22) Filed: Dec. 2, 2008

(65) Prior Publication Data

US 2009/0148195 A1 Jun. 11, 2009

Related U.S. Application Data

(60) Provisional application No. 60/992,936, filed on Dec. 6, 2007.

(51) Int. Cl.
*G03G 15/09* (2006.01)

(52) U.S. Cl. ..... 399/276

(58) Field of Classification Search ..... 399/276, 399/267

See application file for complete search history.

(56) References Cited

U.S. PATENT DOCUMENTS

| | | | | |
|---|---|---|---|---|
| 3,980,404 | A * | 9/1976 | Townsend | 399/276 |
| 4,136,637 | A * | 1/1979 | Snelling | 399/276 |
| 4,368,971 | A * | 1/1983 | Watanabe et al. | 399/276 |
| 4,836,136 | A * | 6/1989 | Natsuhara | 399/276 |
| 5,245,391 | A * | 9/1993 | Suzuki et al. | |
| 6,925,277 | B2 | 8/2005 | Sugihara | |
| 7,555,252 | B2 * | 6/2009 | Aruga et al. | |
| 7,599,650 | B2 * | 10/2009 | Katoh et al. | |
| 2007/0110484 | A1 * | 5/2007 | Yamada et al. | |

FOREIGN PATENT DOCUMENTS

| | | |
|---|---|---|
| JP | 2008-139650 | 6/2008 |

* cited by examiner

*Primary Examiner* — Susan S Lee
(74) *Attorney, Agent, or Firm* — Turocy & Watson, LLP

(57) ABSTRACT

A developing roller includes a cylindrical sleeve that holds developer on a peripheral surface thereof, and a magnet roller being provided in the sleeve and having a plurality of magnetic poles. The sleeve includes a plurality of micro-recesses formed on the peripheral surface thereof, and the plurality of micro-recesses are arranged dispersedly in the axial direction and the circumferential direction of the sleeve. The densities of the micro-recesses in both end portions of the sleeve are larger than the density of the micro-recesses in a central portion of the sleeve.

20 Claims, 8 Drawing Sheets

DEVELOPING ROLLER, DEVELOPING APPARATUS, AND IMAGE FORMING APPARATUS

CROSS-REFERENCE TO RELATED APPLICATION

The present application claims priority under 35 U.S.C. 119 to U.S. Provisional Application Ser. No. 60/992,936, entitled LONGITUDINAL DEVELOPING SLEEVE, to Ochiai, filed on Dec. 6, 2007, the entire disclosure of which is incorporated herein by reference.

TECHNICAL FIELD

The present invention relates to the shape of a developing sleeve in the longitudinal direction and, for example, to a developing roller, a developing apparatus, and an image forming apparatus used in copying machines, printers, facsimiles, and multifunctional peripherals (MFP) using an electrophotographic system.

BACKGROUND

The developing apparatus includes a cylindrical magnet roller opposing a photoconductive drum, a developing sleeve having a peripheral surface which carries developer and being driven to rotate around the magnet roller, and a doctor blade configured to regulate the thickness of a layer of the developer on the peripheral surface of the developing sleeve.

The magnet roller has a plurality of magnetic poles in the interior thereof. The action of a magnetic force forms a magnetic brush formed of magnetic carriers having non-magnetic toner adsorbed thereon on the peripheral surface of the developing sleeve.

The magnetic blush supplies toner to an electrostatic latent image by the magnet roller and the photoconductive drum rotating in a state in which the magnetic blush is in contact with the peripheral surface of the photoconductive drum.

The peripheral surface of the developing sleeve is machined into a rough surface in order to carry the developer of an adequate amount on the peripheral surface thereof and supply the toner to the photoconductive drum, and in order to prevent the developer from slipping on the peripheral surface of the sleeve.

As an example of machining, sandblasting and knurling are known.

In the sandblasting, particles of regular shape or irregular shape are used as abrasives and minute concave-convex are formed on the peripheral surface of the sleeve. In the knurling, a groove extending in parallel with the axis of rotation of the magnet roller is formed over the entire circumference of the peripheral surface of the sleeve.

In the related art, a developing apparatus which employs the developing sleeve having a V-groove is known (U.S. Pat. No. 6,925,277).

The developing apparatus disclosed in U.S. Pat. No. 6,925,277 has a configuration in which the surface of the developing sleeve in a central portion including an image-creating area which corresponds to an image-forming area on a photoconductor is provided with a developer transporting capability higher than the surfaces at the both end portions of the developing sleeve positioned outside the central portion in the widthwise direction being orthogonal to the direction of movement of the surface of the developing sleeve.

In the developing apparatus, the both ends of the magnetic pole of the magnet roller in the widthwise direction are opposed to the surfaces of the developing sleeve at both ends thereof.

In JP-A-2008-139650, a method of uniformizing the amount of transport of the two-component developer in the axial direction after the passage through a layer thickness regulating member by making the capability of the surface of the developing sleeve to carry and transport the two-component developer weaker in the axially central portion than in the axially both end portions is disclosed.

The concave-convex on the peripheral surface of the sandblasted developing sleeve is flattened by the developer during a long time usage. Consequently, the frictional resistance between the peripheral surface of the sleeve and the carrier is lowered and hence the developing sleeve cannot transport the developer stably.

In contrast, the grooves formed by knurling are deeper than the recesses formed by the sandblasting, and hence lowering of the frictional resistance caused by the long time usage is not significantly large.

However, if the knurled developing sleeve is used for developing, a needless pattern of lines having a width corresponding to the groove pitch is disadvantageously generated on the developed toner image.

If the sandblasted developing sleeve is used for developing, the needless pattern of lines is not generated. However, the stability of transport of the developer is disadvantageously impaired by deterioration with age.

SUMMARY

In an aspect of the invention, a developing roller includes a cylindrical sleeve operable to hold developer on a peripheral surface thereof; and a magnet roller provided in the sleeve and having a plurality of magnetic poles, and the sleeve has a plurality of recesses on the peripheral surface thereof, the plurality of recesses are arranged dispersedly in the axial direction and the circumferential direction of the sleeve, and densities of the recesses at both end portions of the sleeve are respectively higher than the density of the recesses at a central portion of the sleeve.

DETAILED DESCRIPTION

Figure 1:
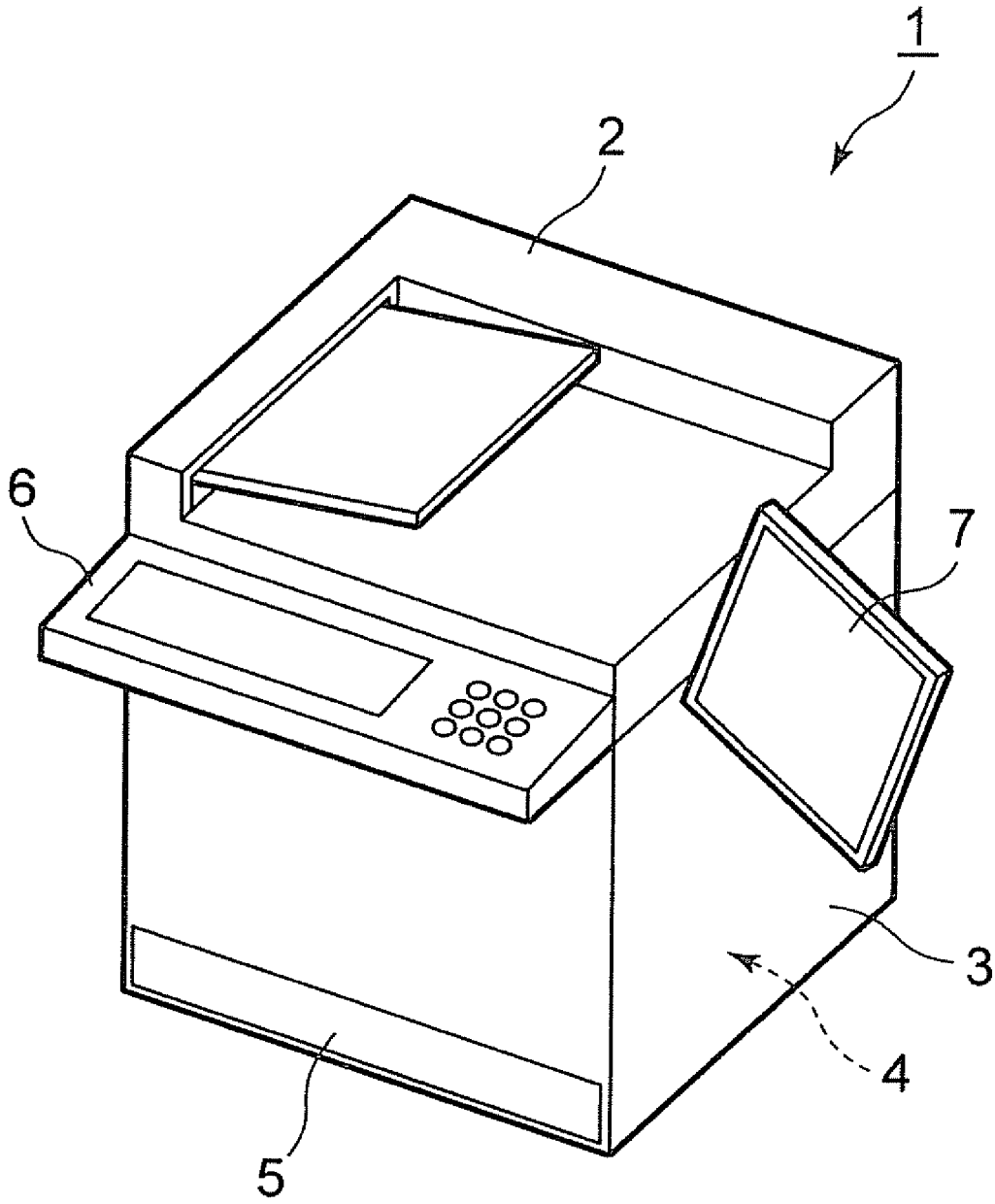
FIG. 1 is a perspective view of a copying machine.

Throughout this description, the embodiments and examples shown should be considered as exemplars, rather than limitations on the apparatus and methods of the invention.

Referring now to the attached drawings, a developing sleeve, a developing apparatus, and an image forming apparatus will be described in detail. In the respective drawings, the same parts are designated by the same reference numerals, and overlapped description will be omitted.

The image forming apparatus in the embodiment is a copying machine. FIG. 1 is a perspective view of the copying machine. A copying machine 1 includes a scanning unit 2 as a scanner, an image forming unit 4 stored in a casing 3, a paper-feeding unit 5 configured to feed paper, a control panel 6 that a user operates, and a display panel 7 that displays information.

The scanning unit 2 scans an original document, and optically reads an image to generate image data. The image forming unit 4 prints the image data on the paper fed from the paper-feeding unit 5 by an electrophotographic system.

Figure 2:
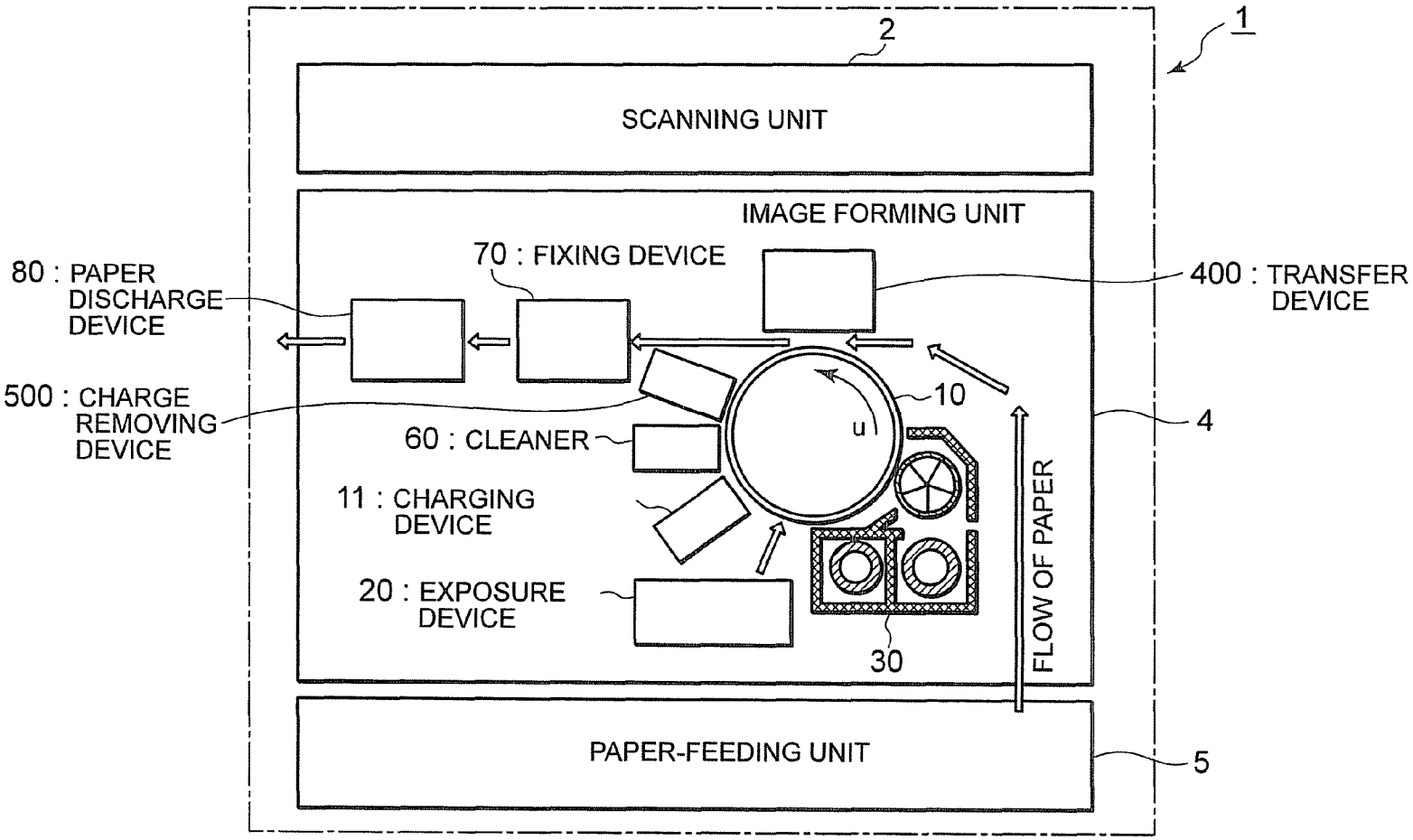
FIG. 2 is a configuration drawing of an image forming unit.

FIG. 2 is a configuration drawing of the image forming unit 4. Components having the same reference numerals as those described above are the same components.

The image forming unit 4 has a photoconductive drum 10 which is driven to rotate in the direction of an arrow u. Provided around the photoconductive drum 10 are a charging device 11, an exposure device 20, a developing apparatus 30, a transfer device 400, a charge removing device 500, and a cleaner 60 in sequence from the upstream to the downstream in the direction of rotation of the photoconductive drum 10.

The charging device 11 charges a peripheral surface of the photoconductive drum 10 with electricity uniformly at a predetermined potential.

The exposure device 20 has a laser beam source, not shown, modulates the laser beam according to the image data entered from the scanning unit 2, and irradiates the peripheral surface of the photoconductive drum 10 with the modulated laser beam. The potential of a portion of the peripheral surface of the photoconductive drum 10 which is irradiated with the laser beam is lowered. An electrostatic latent image is formed on the peripheral surface of the photoconductive drum 10.

The developing apparatus 30 causes developer to attach on the peripheral surface of the photoconductive drum 10, and develops the electrostatic latent image. The developer used here is two-component developer including toner and carriers. Detailed description of the developing apparatus 30 will be given later.

The paper is transported from the paper-feeding unit 5 toward a position where the photoconductive drum 10 opposes the transfer device 400. The transfer device 400 transfers a toner image on the photoconductive drum 10 to the paper.

The paper having the toner image transferred thereto is transported to a fixing device 70 on the downstream side in the transporting direction. The fixing device 70 fixes the toner image to the paper by heating or pressurizing the same. A paper discharge device 80 discharges the paper which has the toner image fixed thereto to the outside of the casing 3.

When the transfer to the paper is completed, the charge removing device 500 removes the electric charge on the surface of the photoconductive drum 10. The cleaner 60 removes the toner remaining on the surface of the photoconductive drum 10. The repetition of the above-described procedures achieves a continuous printing job.

Figure 3:
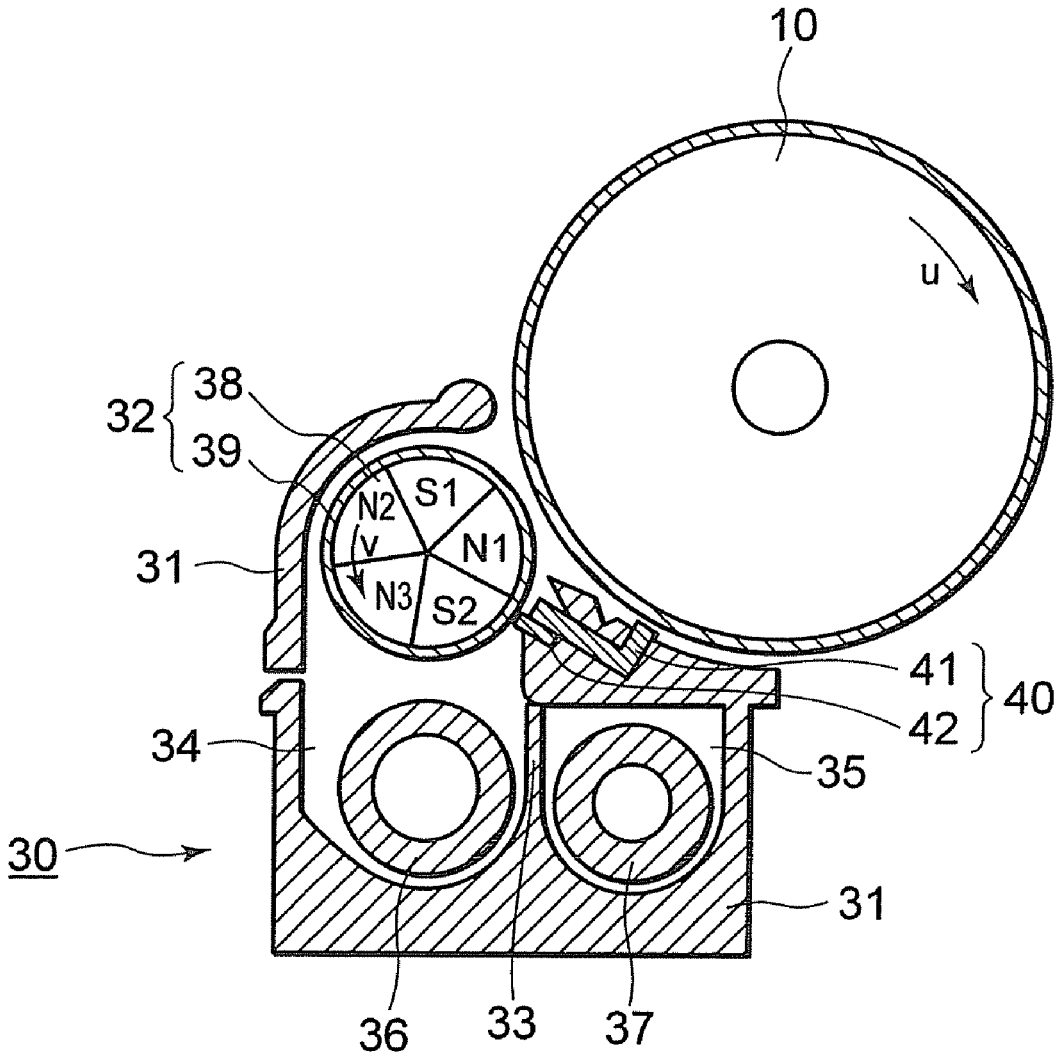
FIG. 3 is a vertical cross-sectional view of a developing apparatus.

FIG. 3 is a vertical cross-sectional view of the developing apparatus 30. In FIG. 3 as well, components having the same reference numerals as those already described are the same components. The cross-section direction taken in FIG. 3 is different from that in FIG. 2.

The developing apparatus 30 includes a container 31 that accommodates the developer and a magnet roller 32 provided in the container 31 and configured to carry the developer on the peripheral surface thereof.

The longitudinal direction of the magnet roller 32 corresponds to the axial direction thereof. Both end portions of the magnet roller 32 in the longitudinal direction are rotatably attached to container walls of the container 31. The longitudinal direction of the magnet roller 32 is parallel to the longitudinal direction of the photoconductive drum 10.

The container 31 is formed with an elongated opening which exposes the peripheral surface of the photoconductive drum 10 along the longitudinal direction of the photoconductive drum 10. The peripheral surface of the magnet roller 32 faces the elongated opening.

The container 31 has a wall 33 below the magnet roller 32. The wall 33 is formed in parallel to the longitudinal direction of the magnet roller 32.

The wall 33 divides a space in the container 31 into a first chamber 34 and a second chamber 35 in the direction parallel to the axial direction of the photoconductive drum 10. The first chamber 34 has a first auger 36 in the interior thereof. The second chamber 35 has a second auger 37 in the interior thereof.

Both end portions of the wall 33 in the longitudinal direction do not continue to the container wall of the container 31, and a portion between the wall 33 and the container walls is opened. The developer circulates in the container 31 via one opening and the other opening of the wall 33, respectively. The two augers 36 and 37 stir the developer and transport the same to the magnet roller 32.

The magnet roller 32 has a column shaped magnet 38 and a cylindrical developing sleeve 39. The magnet 38 includes a combination of five strips extending respectively in the axial direction. An inner peripheral surface of the developing sleeve 39 covers the peripheral surface of the magnet 38.

An aluminum tube is used as the developing sleeve 39. The tube has a number of micro-recesses formed on the peripheral surface thereof.

The magnet 38 is fixed to the container 31. A motor, not shown, provided at an end in the axial direction of the developing sleeve 39 drives and rotates the developing sleeve 39 in the direction indicated by an arrow v. The rotation of the developing sleeve 39 transports the developer to a photoconductor of the photoconductive drum 10.

The developing sleeve 39 and the photoconductive drum 10 rotate respectively at different circumferential speeds. The circumferential speed of the photoconductive drum 10 is within a range from 150 mm/s to 340 mm/s. The circumferential speed of the magnet roller 32 with respect to the circumferential speed of the photoconductive drum 10 is from 1.7 to 2.0 times. The magnet roller 32 rotates in the "With" direction with respect to the photoconductive drum 10.

The magnet roller 32 generates five poles of magnetic force. A developing pole N1 is a pole for forming a developer image on the photoconductor. A transporting pole S1 is a pole for transporting the developer used in developing to the interior of the container 31. A separating pole N2 is a pole for separating the used developer from the magnet roller 32.

A gripping pole N3 is a pole for gripping new developer. A blade regulating pole S2 is a pole opposing a doctor blade 40 which regulates the thickness of the layer of the developer on the peripheral surface of the magnet roller 32. The magnetic field around the magnet roller 32 is formed of the above-described five poles.

The doctor blade 40 includes a sheet metal 41 and a magnetic blade body 42. The sheet metal 41 has the substantially same length as the developing sleeve 39. The blade body 42 is attached to the sheet metal 41 at one end on the side of the magnet roller 32 and has the substantially same length as that of the sheet metal 41.

Both end portions of the sheet metal 41 are fixed to the container walls of the container 31 with screws, not shown. The blade body 42 is fixed to the sheet metal 41 in such a manner that a gap between the blade body 42 and the developing sleeve 39 becomes constant in the axial direction of the developing sleeve 39.

In the developing apparatus 30, static electricity generated by a friction which occurs when being stirred electrostatically couples the toner and the carriers in the developer. The toner and the carriers which are electrostatically coupled are attached to the developing sleeve 39 in the vicinity of the gripping pole N3 by the magnetic force acting between the gripping pole N3 and the carriers.

The attached developer is transported to a position of the blade regulating pole S2 which is adjacent to the gripping pole N3 by the rotation of the developing sleeve 39. The doctor blade 40 is positioned so as to oppose the blade regulating pole S2.

After the transport of the developer through a gap between a corner of the doctor blade 40 and the developing sleeve 39, a layer of the developer having the uniform thickness is formed on the peripheral surface of the developing sleeve 39 after passing the doctor blade 40.

In the layer of the developer, a plurality of the carriers continued along one line of magnetic force form a chain. A plurality of the chains having toner attached to respective carriers form a magnetic brush.

When the rotation of the developing sleeve 39 advances, the developer formed as a layer advances from the position of the blade regulating pole S2 to the position of the developing pole N1 and reaches a developing area. The developing area designates an area between the developing sleeve and the photoconductive drum.

A power source provides a potential of a predetermined value to the developing sleeve 39. In the developing area, the difference between the potential of the developing sleeve 39 and the potential on the electrostatic latent image of the photoconductive drum 10 generates an electric field.

Since the toner is electrically charged, an electric force by the electric field acts on the toner. The toner is attracted onto the electrostatic latent image of the photoconductive drum 10 by the electric force to develop the electrostatic latent image.

The rotation of the developing sleeve 39 transports the toner and the carriers remaining on the developing sleeve 39 from the position of the developing pole N1 to the position of the transporting pole S1, and to the position of the separating pole N2. Both of the separating pole N2 and the gripping pole N3 are N-poles.

The separating pole N2 and the gripping pole N3 generate a force acting on the carrier to separate the same from the peripheral surface of the developing sleeve 39. The force separates the carriers and the toner in the state of being electrostatically coupled with the carriers from the peripheral surface of the developing sleeve 39 and returns the same to the first chamber 34.

A pattern formed on the peripheral surface of the developing sleeve 39 will be described.

The peripheral surface of the developing sleeve 39 is applied with a surface finishing for generating the frictional resistance. The surface finishing is performed in order to prevent the developer from coming apart from the peripheral surface of the sleeve, and in order to transport the developer of a stable amount to the developing position.

Figure 4A:
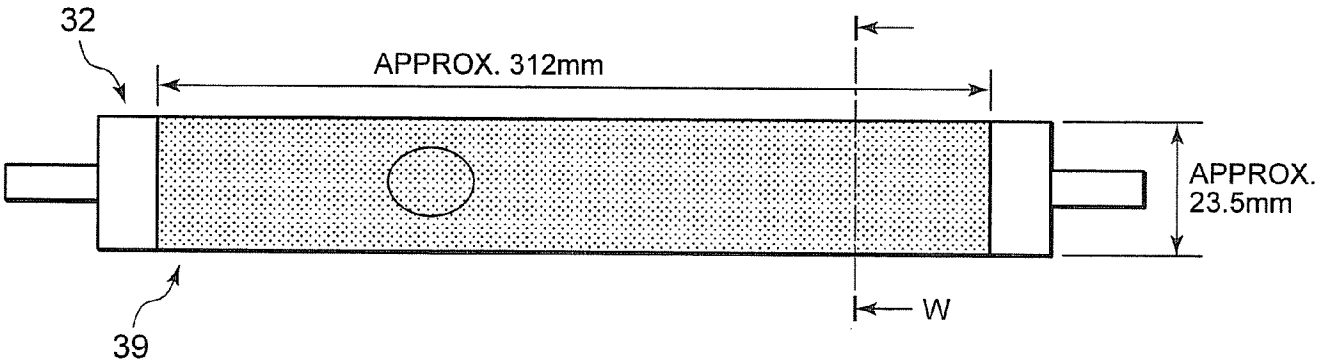
FIG. 4A is a front view of a magnet roller.
Figure 4B:
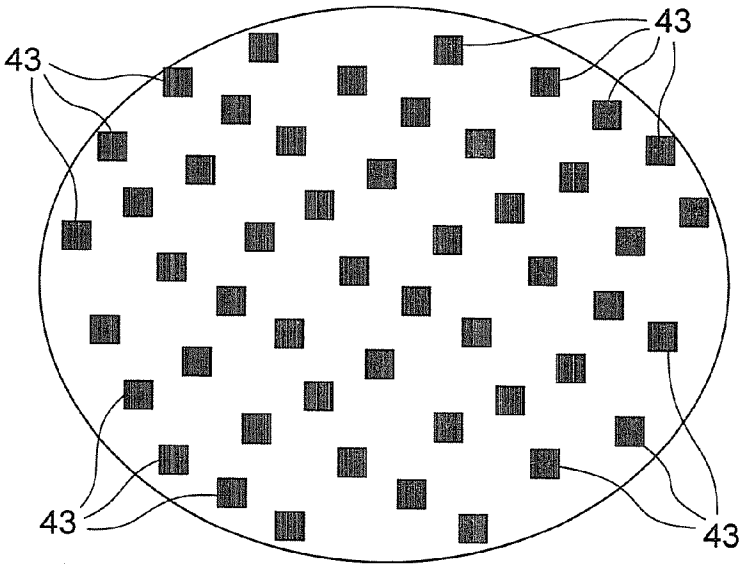
FIG. 4B is an enlarged drawing of a portion of a pattern on a peripheral surface of a developing sleeve.

FIG. 4A is a front view of the magnet roller 32. Components shown in FIG. 4A having the same reference numerals as those described above are the same components. FIG. 4B is an enlarged view of a part of the pattern on the peripheral surface of the developing sleeve 39.

A number of micro-recesses 43 are formed by machining on the peripheral surface of the developing sleeve. The size of each micro-recess 43 is 0.20 mm×0.21 mm. The micro-recesses 43 are arranged dispersedly in both the axial direction and the circumferential direction of the developing sleeve 39.

The micro-recesses 43 are formed by etching. An inkjet apparatus prints ink for masking on the aluminum tube, and then allows the ink to dry. Then, the aluminum tube is soaked into etching solution. Alternatively, the etching solution is applied on the aluminum tube.

Aluminum in the area which is not masked is melt by etching, whereby the micro-recesses 43 are formed.

Subsequently, the ink on the tube is removed to form the developing sleeve 39 having a pattern shown in FIG. 4A and FIG. 4B.

Figure 5:
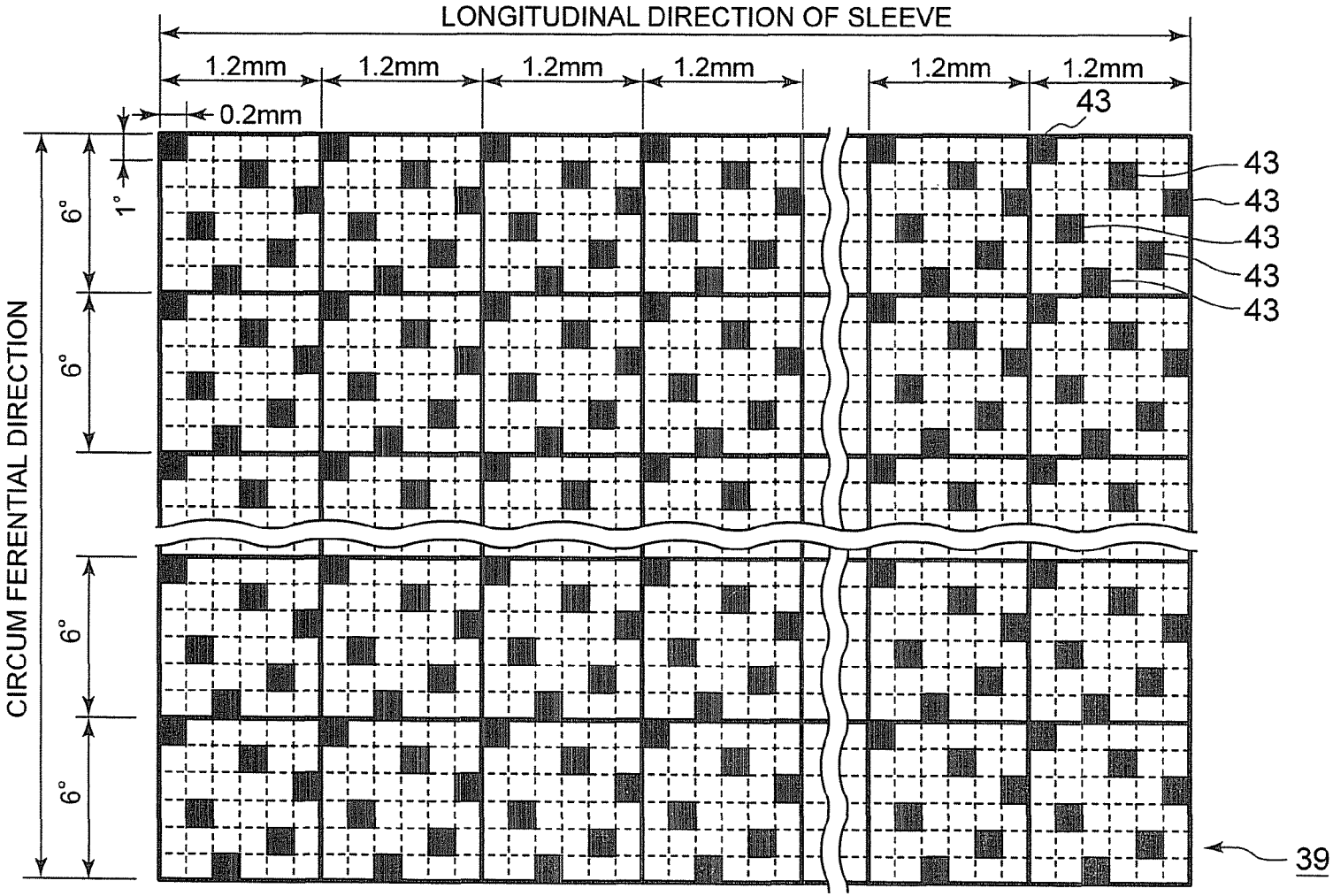
FIG. 5 is a development elevation of a first developing sleeve on the side of a peripheral surface.

FIG. 5 is a development elevation of the developing sleeve 39 on the side of the peripheral surface. The lateral direction in FIG. 5 corresponds to the longitudinal direction of the developing sleeve 39. The vertical direction corresponds to the circumferential direction of the peripheral circle of the developing sleeve 39. The length in the circumferential direction is divided equally corresponding to the angle from 0° to 360°.

As shown in FIG. 5, the micro-recesses 43 are formed at positions of a plurality of virtual cells. The respective cells are apart from each other. The respective cells are obtained by dividing the entire area of the peripheral surface of the developing sleeve 39 into squares of about 0.20 mm in the axial direction and about 0.21 mm in the circumferential direction. These cells are square divided areas, respectively.

The vertical length of a single cell corresponds to an angle of 1° (about 0.21 mm) in the circumferential direction.

Provided between the micro-recesses 43 adjacent in the longitudinal direction of the sleeve is a flat area which corresponds to one or more cells.

Provided between the micro-recesses 43 adjacent in the circumferential direction is a flat area which corresponds to one or more cells. A flat area which corresponds to five cells is provided in each of the axial direction and the circumferential direction.

More specifically, thirty-six cells (six cells in the axial direction and six cells in the circumferential direction) constitute one basic area. Six micro-recesses 43 are arranged in the one basic area.

Figure 6:
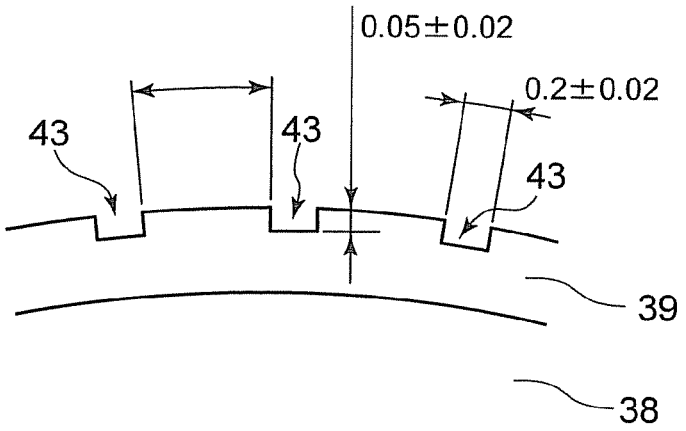
FIG. 6 is a cross-sectional view of the developing sleeve taken along a line W-W in FIG. 4A.

FIG. 6 is a cross-sectional view of the developing sleeve 39 taken along a line W-W in FIG. 4A. Components shown in FIG. 6 having the same reference numerals as those described above are the same components.

The depth of the micro-recesses 43 is determined in view of the developer transporting capability and the easiness of machining of the micro-recesses 43. Preferably, the depth is in the range from 50 μm to 100 μm.

In general, when a human views a printed paper, the human eyes recognize a continuous line more easily than dispersed dots on the paper. Even though the density of the line on the paper is very low, the human eyes recognize the presence of the line if the line is a continuous line.

If a plurality of the lines are arranged periodically at regular distance, the human eyes recognize the presence of the lines more easily.

In FIG. 5, continuity and periodicity are not recognized neither in the longitudinal direction nor the circumferential direction in the entire area of the peripheral surface of the developing sleeve 39. The human eyes have an impression that the micro-recesses 43 are dispersed over the entire area of the peripheral surface of the sleeve.

A pattern having no continuity and periodicity is formed on the peripheral surface of the developing sleeve 39 while maintaining the developer transporting capability.

An opening of the micro-recess 43 has a square shape which is the substantially same as the shape of the single cell. The openings each have the same size as the size of the cell. The shape and the size of the micro-recess 43 do not necessarily have to be the same shape and the size of the cell.

The shape of the opening of the micro-recess 43 may be, for example, a circular shape.

An example shown in FIGS. 4 to 6 described thus far is a first example of the pattern formed on the peripheral surface of the sleeve used for the magnet roller 32.

Other patterns may be formed on the sleeve. A second example of the pattern to be formed on the peripheral surface of the sleeve will be described below. The second pattern will be described in comparison with the first pattern.

In FIG. 5, the micro-recesses 43 are not continued. The micro-recesses 43 are dispersed on the peripheral surface of the sleeve as a dot pattern. The micro-recesses 43 are formed by etching.

Since the shape of the peripheral surface of the sleeve does not change with time, the amount of the developer on the magnet roller 32 during the lifetime does not change. The amount of transport does not change as well. The amount of transport represents the amount of the developer per unit surface area on the magnet roller 32 after the passage through the doctor blade 40.

The toner is stably supplied to the photoconductive drum 10 from the beginning during the lifetime. Since the micro-recesses 43 are not arranged continuously, the cell shapes do not appear on the image of half tone or the like on the printed paper, and hence a high-quality image is obtained.

However, the doctor blade 40 is subject to a pressure from the developer, and hence the doctor blade 40 is deformed. Both end portions of the doctor blade 40 are fixed to the container 31 with screws.

Therefore, even when the amount of transport is small, a central portion of the doctor blade 40 in the longitudinal direction is deformed by the pressure. If the amount of transport increases, it causes a difference between the amounts of transport by the both end portions of the doctor blade 40 and by the central portion thereof.

Consequently, it causes a variation in thickness of the layer of the developer on the magnet roller 32. Therefore, the difference in amount of supply of the toner to the photoconductive drum 10 is resulted. This difference occurs from position to position in the longitudinal direction.

If the developing sleeve 39 formed with the first pattern is employed, there arises a difference in the density between the both edges of the paper and the central portion of the paper with respect to the paper transport direction in the entire area of one sheet of paper.

Therefore, the inventor proposes a sleeve formed with the second pattern. The second pattern is a pattern which achieves the uniform amount of transport on the peripheral surface of the magnet roller between the both end portions and the central portion of the sleeve.

Figure 7:
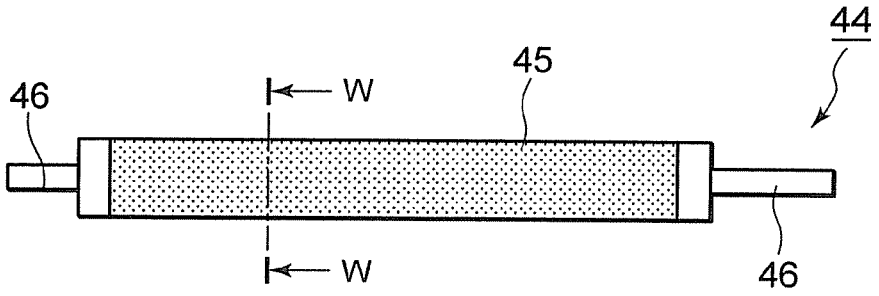
FIG. 7 is a front view of the magnet roller having a sleeve shape of a second pattern.

FIG. 7 is a front view of the magnet roller having a sleeve shape of the second pattern. A magnet roller 44 shown in FIG. 7 has a column shaped magnet, not shown, and a cylindrical developing sleeve 45.

The magnet includes a combination of five strips fixed respectively to the container 31. The developing sleeve 45 covers the magnet.

The developing sleeve 45 carries the developer on the peripheral surface thereof. A shaft 46 of the magnet roller 44 is rotatably provided on the container walls of the container 31 of the developing apparatus 30. A motor, not shown, drives and rotates the shaft 46. The cross-sectional shape of the developing sleeve 45 taken along the line W-W is the same as the example shown in FIG. 6.

Figure 8:
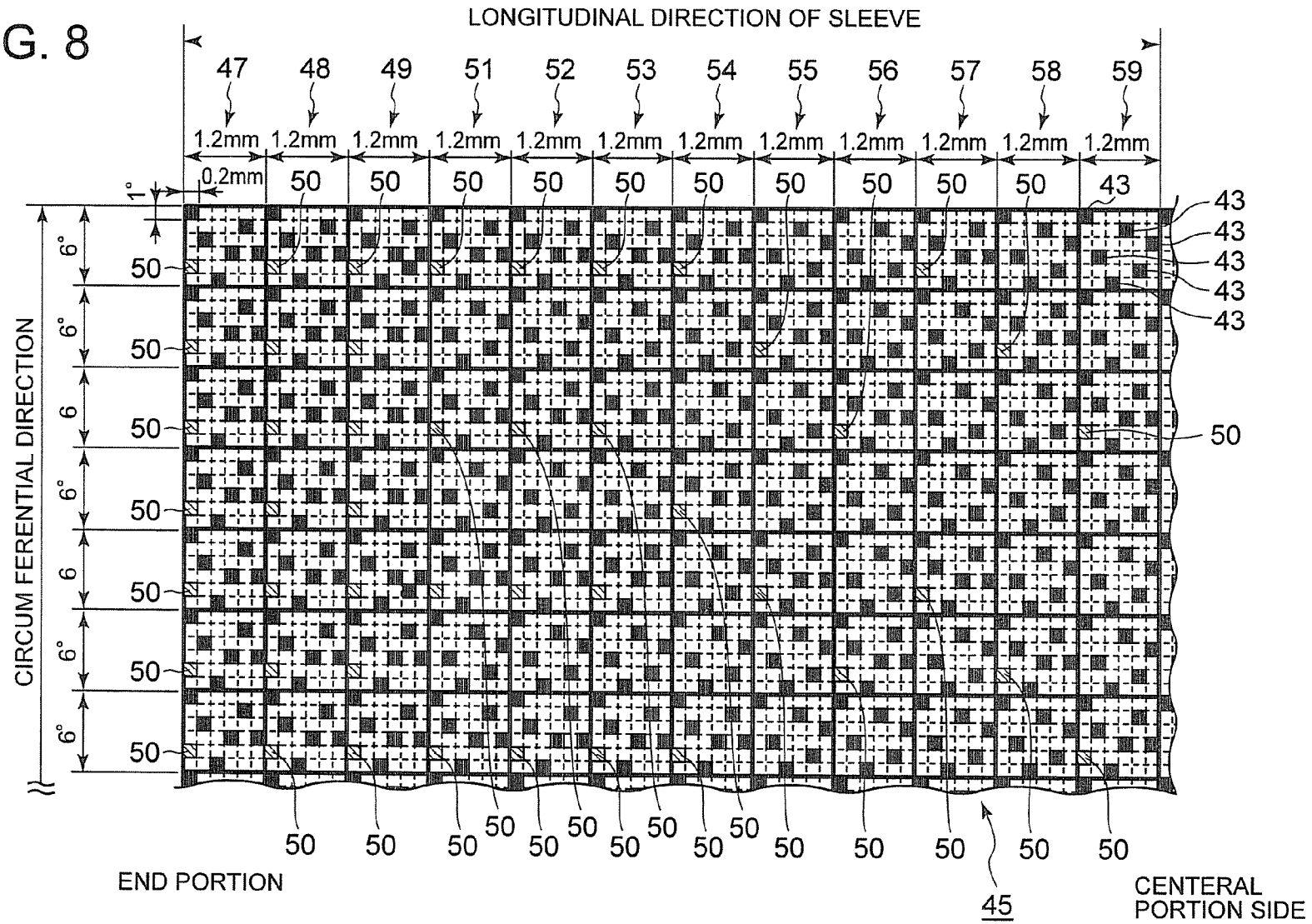
FIG. 8 is a development elevation of a second developing sleeve on the side of a peripheral surface.

FIG. 8 is a development elevation of the developing sleeve 45 on the side of the peripheral surface thereof. The lateral direction corresponds to the longitudinal direction of the developing sleeve 45. The vertical direction corresponds to the circumferential direction of the peripheral circle of the side surface of the developing sleeve 45. A plurality of virtual cells are arranged in the vertical direction and the lateral direction.

Black squares are the micro-recesses 43, described above. The magnet roller 44 includes micro-recesses 50 shown with hatching formed on the peripheral surface of the developing sleeve 45.

One basic area including thirty-six cells of 6×6 each having a size of 0.2 mm×0.2 mm includes the micro-recesses 43 and 50 arranged at random. Thirty-six cells are square divided areas, respectively. The recess pattern is formed by arranging these recesses.

The depth of the each recess is from 50 μm to 120 μm. The surface of the developing sleeve 45 is machined by etching.

The left side of FIG. 8 is one end portion of the developing sleeve 45. The right side thereof shows a portion between one end portion and the central portion of the developing sleeve 45. Groups 47, 48, and 49 of the basic areas (36 cells) each having a width of 1.2 mm in the longitudinal direction are formed in the circumferential direction.

All the basic areas which belong to the group 47 of the basic areas each have one additional micro-recess 50. The basic areas in the group 47 each have thirty-six cells including seven micro-recesses 43 and 50.

All the basic areas which belong to the group 48 of the basic areas each have the micro-recess 50 as well. The group 49 of the basic areas is also the same.

Groups 51, 52, and 53 of the basic areas (36 cells) are formed in the circumferential direction. A circumferentially first basic area which belongs to the group 51 of the basic areas includes seven micro-recesses 43 and 50.

A circumferentially second basic area does not include the additional micro-recess, and the number of the micro-recesses 43 is six. A circumferentially third basic area include the micro-recess 50 formed therein and the number of the micro-recesses 43 and 50 is seven.

In other words, in the group 51 of the basic areas, the micro-recess 50 is added every other basic area. In the group 52 of the basic areas as well, the micro-recess 50 is added every other basic area. In the same manner, in the group 53 of the basic areas as well, the micro-recess 50 is added every other basic area.

Groups 54, 55, and 56 of the basic areas (36 cells) are formed in the circumferential direction. A first basic area in the circumferential direction which belongs to the group 54 of the basic areas includes seven micro-recess areas 43 and 50.

The number of the micro-recesses 43 in a circumferentially second basic area is six. The number of the micro-recesses 43 in a circumferentially third basic area is six. The number of the micro-recesses 43 and 50 in a circumferentially fourth basic area is seven.

This pattern is repeated along the circumferential direction. In other words, in the group 54 of the basic areas, the micro-recess 50 is added every two basic areas.

The number of the micro-recesses 43 in a circumferentially first basic area which belongs to the group 55 of the basic areas is six. The number of the micro-recesses 43 and 50 in a circumferentially second basic area is seven. The number of the micro-recesses 43 in a circumferentially third basic area is six. The number of the micro-recesses 43 in a circumferentially fourth basic area is six. The number of the micro-recesses 43 and 50 in a circumferentially fifth basic area is seven.

This pattern is repeated along the circumferential direction. In the group 55 of the basic areas as well, the micro-recess 50 is added every two basic area. In the same manner, in the group 56 of the basic areas as well, the micro-recess 50 is added every two basic areas.

Groups 57, 58, and 59 of the basic areas (36 cells) are formed in the circumferential direction. The number of the micro-recesses 43 and 50 in a circumferentially first basic area which belongs to the group 57 of the basic areas is seven.

A circumferentially second basic area, a circumferentially third basic area, and a circumferentially fourth basic area each have the six micro-recesses 43. The number of the micro-recesses 43 and 50 in a circumferentially fifth basic area is seven.

This pattern is repeated along the circumferential direction. In other words, in the group 57 of the basic areas, the micro-recess 50 is added every three basic areas.

The number of the micro-recesses 43 in a circumferentially first basic area which belongs to the group 58 of the basic areas is six. The number of the micro-recesses 43 and 50 in a circumferentially second basic area is seven.

A circumferentially third basic area, a circumferentially fourth basic area, and a circumferentially fifth basic area each have the six micro-recesses 43. The number of the micro-recesses 43 and 50 in a circumferentially sixth basic area is seven.

This pattern is repeated along the circumferential direction. In the group 58 of the basic areas as well, the micro-recess 50 is added every three basic areas. In the same manner, in the group 59 of the basic areas as well, the micro-recess 50 is added every three basic areas.

In this manner, the groups 47, 48, and 49 of the basic areas within the three rows from the end each have seven micro-recesses. In the groups 51, 52, and 53 of the basic areas within the next three rows, the basic areas each having seven micro-recesses are arranged every other basic area in the circumferential direction.

In the groups 54, 55, and 56 of the basic areas which correspond to the next three rows, the basic areas each having seven micro-recesses are arranged every two basic areas in the circumferential direction.

In the groups 57, 58, and 59 of the basic areas which correspond to the next three rows, the basic areas each having seven micro-recesses are arranged every three basic areas in the circumferential direction.

Therefore, the density of the micro-recesses of the developing sleeve 45 in the circumferential direction differs according to the position in the longitudinal direction of the sleeve. The pattern is formed on the peripheral surface of the sleeve in such a manner that the density is reduced from the one end of the developing sleeve 45 toward the central portion thereof.

The pattern from the central portion to the other end of the developing sleeve 45 which is not shown is also formed in symmetry with respect to the example shown in FIG. 8.

Figure 9:
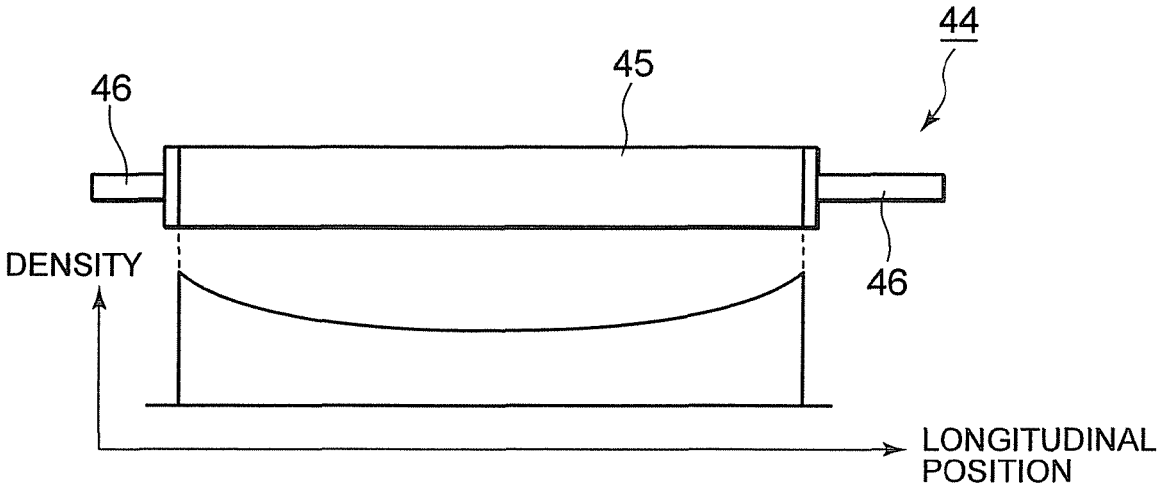
FIG. 9 is a drawing showing the relation between the longitudinal position of the developing sleeve and the coefficient of the surface area at the corresponding position.

In this manner, the density of the recesses is different between the respective end portions of the developing sleeve 45 and the central portion. FIG. 9 shows the position of the developing sleeve in the longitudinal direction and the relation between the position and the density.

The micro-recesses 50 in the group 54 of the basic areas, the micro-recesses 50 in the group 55 of the basic areas, and the micro-recesses 50 in the group 56 in the basic areas are shifted with respect to each other in the longitudinal direction.

The basic areas to be added the micro-recesses 50 are selected so as to avoid the basic areas having the seven micro-recesses 43 and 50 from being aligned continuously in the longitudinal direction. The basic areas are selected so as to avoid the basic areas having the seven micro-recesses 43 and 50 from being arranged in the circumferential direction having the same value.

The micro-recesses 50 in the group 57 of the basic areas, the micro-recesses 50 in the group 58 of the basic areas, and the micro-recesses 50 in the group 59 in the basic areas are shifted with respect to each other in the longitudinal direction.

When the copying machine 1 having the developing apparatus 30 in this configuration performs the image formation, the doctor blade 40 of the developing apparatus 30 is deformed. A gap between the doctor blade 40 and the magnet roller 44 is narrow in the both end portions and is wide in the central portion.

Since the density of the micro-recesses in the central portion is lower than the density of the micro-recesses in the both end portions, the transporting capability in the central portion is lower. At the respective positions in the longitudinal direction, the amount of the developer corresponding to the gap and the amount of the developer corresponding to the added micro-recesses 50 are cancelled out.

Since the uniform amount of transport of the developer is achieved in the both end portions and the central portions, the difference in photographic density in the area of one sheet of paper is avoided.

The number of the patterns having holes from among the cells on the magnet roller 44 is larger in the both end portions and smaller in the central portion. Since the developer is transported by the concave-convex, the developer transporting capability of the magnet roller 44 is higher in the both end portions of the magnet roller 44.

Even though the doctor blade 40 is sagged in the central portion and the amount of transport of the developer in the central portion increases, the amounts of transport of the developer in the both end portions are set to be larger by the pattern of the magnet roller 44. The same level of the amount of transport is achieved in the central portion and the both end portions. Accordingly, the uniform image is obtained.

In the etching pattern of the magnet roller 44 in the second pattern, the surface areas in the both end portions having the recesses are larger than the surface area in the central portion having the recesses. The peripheral surface of the sleeve of the magnet roller 44 in the both end portions have the developer transporting capability and transport a larger amount of the developer.

In other words, the events such that the amount of transport is larger in the both end portions, and that the amount of transport in the central portion is increased by sagging of the doctor blade 40 are cancelled out. The amount of transport is uniformized in the longitudinal direction and hence the uniform image in the longitudinal direction is obtained.

In other words, in the second pattern, the plurality of cells are formed on the peripheral surface of the sleeve, which is common to the first pattern in that the micro-recesses are formed in the respective cells. The second pattern is different from the first pattern in the following points (1) to (4).

(1) The density of the recesses in the both end portions of the sleeve and the density of the recesses in the central portion of the sleeve can be differentiated. The recesses are formed on the peripheral surface of the sleeve in such a manner that the density in the both end portions is higher than in the central portion.

(2) The recesses are formed on the peripheral surface of the sleeve in such a manner that the number of the recesses in the both end portions of the sleeve is larger than the number of the recesses in the central portion of the sleeve by about 20%.

The inventor conducted an experiment using the developing sleeve 39 having the first pattern formed thereon, the amount of transport in the central portion of the sleeve was 50 $mg/cm^2$, and the respective amounts of transport in the both end portions of the sleeve were 40 $mg/cm^2$.

In the developing sleeve having the second pattern formed thereon, the number of the recesses in the both end portions of the sleeve is set to be larger than the number of the recesses in the central portion of the sleeve by about 20%.

(3) The density of the recesses is adapted to change linearly from the one end portion to the central portion also when the recesses are arranged using a standard threshold array obtained by a known error diffusion method as an array pattern as well.

(4) The number of the recesses included in one basic area having 6×6 cells is six. When increasing the number of the recesses included in the basic area, the value of the density is dispersed by arranging the recesses not aligned in the axial direction, but by staggering in the axial direction.

In this manner, since the density of the micro-recesses 43 and 50 in the both end portions in the longitudinal direction of the developing sleeve 39 is high, the toner transport capabilities in the left and right end portions are increased.

Since the transport capability in the central portion is smaller than the transport capabilities in the both end portions, a good balance is achieved in view of the relation between the transport capability and warp of the doctor blade 40.

In FIG. 8, the density of the micro-recesses 50 is changed every three rows of the groups of the basic areas. The density of the micro-recesses 50 may be changed every four rows, or may be every five rows.

In the embodiment shown above, the number of the cells in the basic area is 6×6. The number of the cells may be 12×12, or 18×18.

In the case of the size of 6×6, the number of the micro-recesses 50 to be added to one basic area may be two or larger. In this case, the micro-recesses 43 and 50 are arranged so as not to be continued each other.

In the case of the sizes of 12×12, or 18×18 as well, the number of the micro-recesses 50 to be added to one basic area may be two or larger. In this case, the micro-recesses 43 and 50 are arranged so as not to be continued each other.

The size of the cells to be arranged in the basic area such as 6×6, the number of the micro-recesses 50 to be added to the one basic area, dimensions of the each cell in the circumferential direction and the longitudinal direction are determined so that the amount of transport of the developer falls within a predetermined range. The patterns of the micro-recesses 43 and 50 are changed variously according to the value of the amount of transport.

The size such as 6×6, 12×12, or 18×18 is determined by setting an area having a desired size on the peripheral surface of the sleeve so as to obtain an intended coefficient of surface area in the area. The coefficient of the surface area is a ratio of the area that the micro-recesses occupy with respect to the entire surface area.

The coefficient of surface area is a ratio between the gross area where the holes are present and the gross area where no hole is present in a certain area. In order to change the coefficient of the surface area, the size such as 6×6 or 12×12 is selected. The nature that the amount of transport varies with the coefficient of surface area is utilized.

The size of the cell is selected so that the coefficient of surface area in the both end portions becomes 30 to 35 or 40%, while the coefficient of surface area in the central portion is 20 to 30%. In the developing sleeve 39, the coefficient of surface area is different between the both end portions and the central portion. The value of the density of the vertical axis in FIG. 9 corresponds to the coefficient of surface area.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A developing roller comprising:

a cylindrical sleeve operable to hold developer on a peripheral surface thereof; and a magnet roller provided in the sleeve and having a plurality of magnetic poles, the sleeve having a plurality of recesses on the peripheral surface thereof, the plurality of recesses being arranged dispersedly in the axial direction and the circumferential direction of the sleeve, and densities of the recesses at both end portions of the sleeve being respectively higher than the density of the recesses at a central portion of the sleeve.

2. The developing roller of claim 1, wherein the peripheral surface of the sleeve is divided by a plurality of axial lines extending in parallel to the axial direction on the peripheral surface and a plurality of circumferential lines extending in parallel to the circumferential direction on the peripheral surface, the plurality of axial lines intersecting the plurality of circumferential lines, the peripheral surface having a plurality of square basic areas each having a predetermined surface area, the plurality of basic areas each are further divided by a plurality of other axial lines extending in parallel to the axial direction and a plurality of other circumferential lines extending in parallel to the circumferential direction, the plurality of other axial lines intersecting the plurality of other circumferential lines, the plurality of basic areas each having a plurality of square divided areas each having a surface area obtained by dividing the predetermined surface area, and the recess is formed in at least one divided area in each of the plurality of basic areas, and the density of the recesses is the number of the recesses in the one basic area.

3. The developing roller of claim 2, wherein the numbers of the recesses in each of the basic areas located in the both end portions of the sleeve are larger than the number of the recesses in the one basic area located in the central portion of the sleeve.

4. The developing roller of claim 2, wherein, the numbers of recesses included in the basic areas corresponding to one full circle in the circumferential direction in the both end portions of the sleeve each are larger than the number of recesses included in the basic areas corresponding to one full circle in the circumferential direction in the central portion of the sleeve by 20%.

5. The developing roller of claim 2, wherein, the density in a portion between the one end portion and the central portion of the sleeve linearly changes from the one end portion toward the central portion.

6. The developing roller of claim 2, wherein, if the plurality of basic areas each having one additional recess formed therein are to be arranged along the axial direction, the positions of the plurality of basic areas having the additional recess formed therein are shifted with respect to each other in the circumferential direction.

7. The developing roller of claim 1, wherein, the peripheral surface of the sleeve is divided by a plurality of axial lines extending in parallel to the axial direction on the peripheral surface and a plurality of circumferential lines extending in parallel to the circumferential direction on the peripheral surface, the plurality of axial lines intersecting the plurality of circumferential lines, the peripheral surface having a plurality of square basic areas each having a predetermined surface area, and the plurality of recesses are formed in each of the plurality of basic areas, and coefficients of surface area in the both end portions of the sleeve each are larger than a coefficient of the surface area in the central portion of the sleeve, assuming that the ratio of a total surface area that the plurality of recesses in the one basic area occupy with respect to the predetermined surface area is the coefficient of surface area.

8. A developing apparatus comprising:

a container that accommodates developer;

a cylindrical sleeve provided in the container and operable to hold the developer on a peripheral surface thereof;

a magnet roller provided in the sleeve and having a plurality of magnetic poles; and a regulating member arranged to oppose the sleeve to regulate the thickness of a layer of the developer on the peripheral surface, the sleeve having a plurality of recesses formed on the peripheral surface thereof, the plurality of recesses being arranged dispersedly in the axial direction and the circumferential direction of the sleeve, and densities of the recesses at both end portions of the sleeve being respectively higher than the density of the recesses at a central portion of the sleeve.

9. The developing apparatus of claim 8, wherein, the peripheral surface of the sleeve is divided by a plurality of axial lines extending in parallel to the axial direction on the peripheral surface and a plurality of circumferential lines extending in parallel to the circumferential direction on the peripheral surface, the plurality of axial lines intersecting the plurality of circumferential line, the peripheral surface having a plurality of square basic areas each having a predetermined surface area, the plurality of basic areas each are further divided by a plurality of other axial lines extending in parallel to the axial direction and a plurality of other circumferential lines extending in parallel to the circumferential direction, the plurality of other axial lines intersecting the plurality of other circumferential lines, the plurality of basic areas each having a plurality of square divided areas each having a surface area obtained by dividing the predetermined surface area, and the recess is formed in at least one divided area in each of the plurality of basic areas, and the density of the recesses is the number of the recesses in the one basic area.

10. The developing apparatus of claim 9, wherein, the numbers of the recesses in each of the basic areas located in the both end portions of the sleeve are larger than the number of the recesses in the one basic area located in the central portion of the sleeve.

11. The developing apparatus of claim 9, wherein, the numbers of recesses included in the basic areas corresponding to one full circle in the circumferential direction in the both end portions of the sleeve each are larger than the number of recesses included in the basic areas corresponding to one full circle in the circumferential direction in the central portion of the sleeve by 20%.

12. The developing apparatus of claim 9, wherein, the density in a portion between the one end portion and the central portion of the sleeve linearly changes from the one end portion toward the central portion.

13. The developing apparatus of claim 9, wherein, if the plurality of basic areas each having one additional recess formed therein are to be arranged along the axial direction, the positions of the plurality of basic areas having the additional recess formed therein are shifted with respect to each other in the circumferential direction.

14. The developing apparatus of claim 8, wherein, the peripheral surface of the sleeve is divided by a plurality of axial lines extending in parallel to the axial direction on the peripheral surface and a plurality of circumferential lines extending in parallel to the circumferential direction on the peripheral surface, the plurality of axial lines intersecting the plurality of circumferential lines, the peripheral surface having a plurality of basic areas each having a predetermined surface area, and the plurality of recesses are formed in each of the plurality of basic areas, and coefficients of surface area in the both end portions of the sleeve each are larger than a coefficient of the surface area in the central portion of the sleeve, assuming that the ratio of a total surface area that the plurality of recesses in the one basic area occupy with respect to the predetermined surface area is the coefficient of surface area.

15. An image forming apparatus comprising:

a photoconductor;

a charger that charges a surface of the photoconductor;

an exposure that exposes the photoconductor and forms a latent image on the photoconductor;

a container that has an opening opposing the photoconductor and accommodates developer;

a cylindrical sleeve provided in the container to oppose the photoconductor and is operable to hold the developer on a peripheral surface thereof;

a magnet roller provided in the sleeve and having a plurality of magnetic poles;

a regulating member arranged in the container to oppose the sleeve to regulate the thickness of a layer of the developer on the peripheral surface; and a transfer unit configured to transfer a toner image adhered to the latent image on the photoconductor to a sheet of paper by the developer carried by the sleeve, the sleeve having a plurality of recesses on the peripheral surface thereof, the plurality of recesses being arranged dispersedly in the axial direction and the circumferential direction of the sleeve, and densities of the recesses at both end portions of the sleeve being respectively higher than the density of the recesses at the central portion of the sleeve.

16. The image forming apparatus of claim 15, wherein, the peripheral surface of the sleeve is divided by a plurality of axial lines extending in parallel to the axial direction on the peripheral surface and a plurality of circumferential lines extending in parallel to the circumferential direction on the peripheral surface, the plurality of axial lines intersecting the plurality of circumferential line, the peripheral surface having a plurality of square basic areas each having a predetermined surface area, the plurality of basic areas each are further divided by a plurality of other axial lines extending in parallel to the axial direction and a plurality of other circumferential lines extending in parallel to the circumferential direction, the plurality of other axial lines intersecting the plurality of other circumferential lines, the plurality of basic areas each having a plurality of square divided areas each having a surface area obtained by dividing the predetermined surface area, and the recess is formed in at least one divided area in each of the plurality of basic areas, and the density of the recesses is the number of the recesses in the one basic area.

17. The image forming apparatus of claim 16, wherein, the numbers of the recesses in each of the basic areas located in the both end portions of the sleeve is larger than the number of the recesses in the one basic areas located in the central portion of the sleeve.

18. The image forming apparatus of claim 16, wherein, the numbers of recesses included in the basic areas corresponding to one full circle in the circumferential direction in the both end portions of the sleeve each are larger than the number of recesses included in the basic areas corresponding to one full circle in the circumferential direction in the central portion of the sleeve by 20%.

19. The image forming apparatus of claim 16, wherein, the density in a portion between the one end portion and the central portion of the sleeve linearly changes from the one end portion toward the central portion.

20. The image forming apparatus of claim 16, wherein, if the plurality of basic areas each having one additional recess formed therein are to be arranged along the axial direction, the positions of the plurality of basic areas having the additional recess formed therein are shifted with respect to each other in the circumferential direction.

* * * * *